US007184370B2

(12) United States Patent
Rogacki et al.

(10) Patent No.: US 7,184,370 B2
(45) Date of Patent: Feb. 27, 2007

(54) WATERPROOF PACE CLOCK

(76) Inventors: Daniel Joseph Rogacki, 40 Tenney Rd., Sandown, NH (US) 03873; Francis X. Graney, 50 Vale St., Tewksbury, MA (US) 01876

( * ) Notice: Subject to any disclaimer, the term of this patent is extended or adjusted under 35 U.S.C. 154(b) by 815 days.

(21) Appl. No.: 10/369,739

(22) Filed: Feb. 20, 2002

(65) Prior Publication Data

US 2004/0052163 A1 Mar. 18, 2004

(51) Int. Cl.
*G04F 8/00* (2006.01)
*G04F 10/00* (2006.01)

(52) U.S. Cl. ..... 368/107; 368/110; 368/112

(58) Field of Classification Search ..... 368/3, 368/10, 107, 110–113; 340/323 R; 377/15, 377/20, 24

See application file for complete search history.

(56) References Cited

U.S. PATENT DOCUMENTS 4,518,266 A * 5/1985 Dawley ..... 368/10
4,700,369 A * 10/1987 Siegal et al. ..... 377/24.2
4,932,045 A * 6/1990 Kasoff et al. ..... 377/24.2
4,993,004 A * 2/1991 Loizeaux ..... 368/107
5,136,621 A * 8/1992 Mitchell et al. ..... 377/24.2
5,349,569 A * 9/1994 Tanaka ..... 368/10
5,812,049 A * 9/1998 Uzi ..... 340/323 R

* cited by examiner

*Primary Examiner*—Vit W. Miska

(57) ABSTRACT

Underwater pace clock allows competitive and recreational swimmers the benefit of being able to observe training times without having to stop to observe a pool area clock. This invention will be solar and/or battery operated with a reset mechanism allowing synchronization with pool area clocks for benefit of instructional staff.

12 Claims, 2 Drawing Sheets

WATERPROOF PACE CLOCK

BACKGROUND OF THE INVENTION

Swimming has grown as an important competitive sport. It has also grown as a very important fitness tool for thousands of others. Walk into any competitive or fitness pool and you will see at least one and sometimes up to as many as seven clocks fixed to the wall or mobile clocks on the deck area. These clocks are used for pacing and timing during swim training.

Competitive and fitness training has evolved considerably. Today, interval training is the basic tool of the swimmer's development and requires the swimmer to keep track of his/her time so that s/he can vary the intensity within pre-designed training sets. The current timing situation requires the swimmer to attempt to view the wall/deck clock resulting in a pause in stroke.

In distance training or competition, the swimmer must be able to pace his/herself to be most effective. Currently, the swimmer must pause and sight an on deck clock or simply trust his own inner timing. The end result is often a swim for a distance that is concluded with a surplus of energy or the opposite.

SUMMARY OF THE INVENTION

The present invention, an underwater pace clock, can be placed as a free-standing unit at the bottom of the pool. A swimmer, without disruption of his or her stroke, readily sees the easy-to-read digital display. This provides the swimmer with a very significant addition of control over his/her effectiveness in training or competition. The swimmer can reset the clock simply by tilting the apparatus forward by 90 degrees and activating the mercury switch setting the display back to zero. Furthermore, the underwater pace clock may be synchronized with the wall clock.

DETAILED DESCRIPTION OF THE INVENTION

Figure 1:
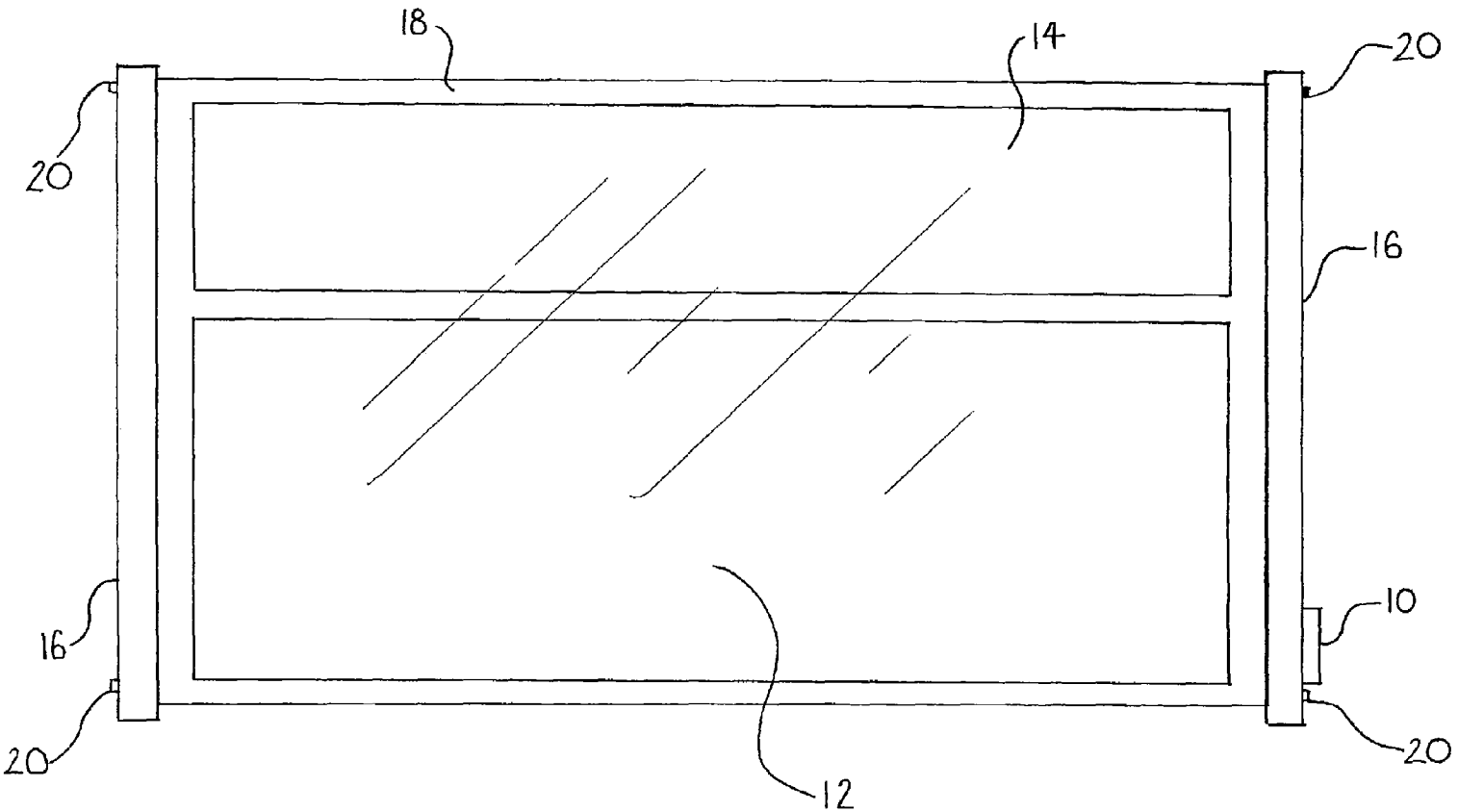
FIG. 1. Is a front view of the present invention.
Figure 2:
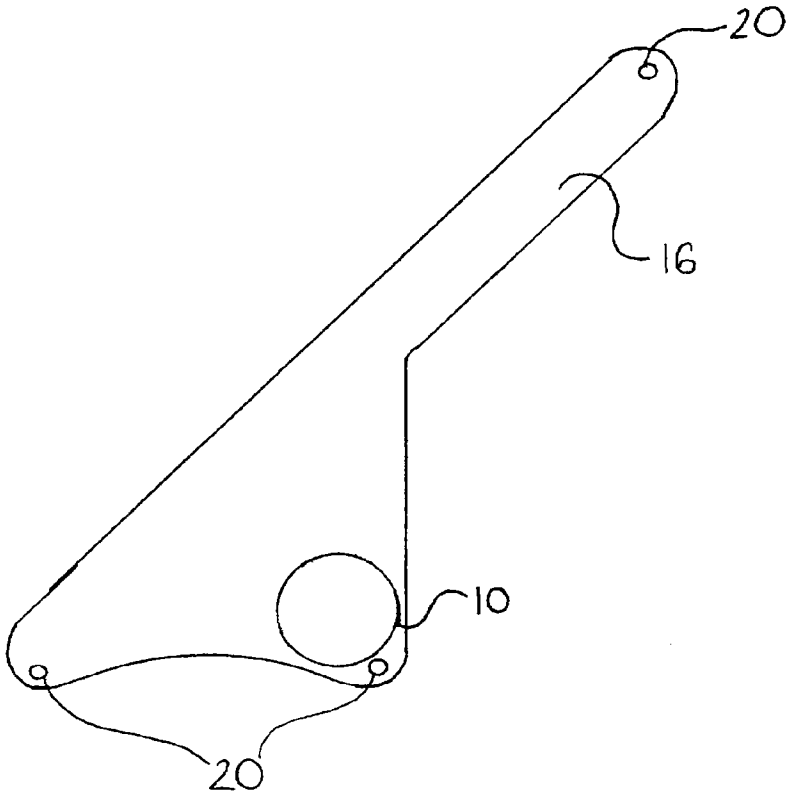
FIG. 2. Is a side view with battery compartment cap on off switch

The extruded plexiglas tube 18 is formed into a special shape and cut to length. Solar panel and internal electronic circuit board including the mercury switch 14 together with liquid crystal display 12 are inserted into the cut extruded plexiglas tube 18. Two machined endcaps 16 each with an O-ring seal for water tightness are specifically grooved to accept shaped form 18 and positioned as illustrated in FIG. 1. The endcaps 16 are fastened by three threaded rods with six nuts 20. The fastening of the nuts exert a pull on the endcaps to complete the watertight seal. The individual cap 10 seals the opening that allows battery replacement and the on off switch.

We claim:

1. A waterproof pace clock, comprising:

a waterproof housing, a time display panel, a reset switch that is activatable by tilting the pace clock, an energy source, and an electronic timer circuit board, the waterproof housing being sufficiently weighted so as to be mountable at a bottom of a pool.

2. The pace clock of claim 1, wherein the reset switch is a mercury switch.

3. The pace clock of claim 1, wherein the time display panel includes a digital display that is readily visible to swimmers.

4. The pace clock of claim 1, wherein the energy source is solar based.

5. The pace clock of claim 1, wherein the energy source is a battery.

6. A competitive swimming pace clock, comprising:

a fully submersible waterproof enclosure having a transparent face;

a time display panel adjacent the transparent face at a front portion thereof, the time display panel to the including a digital display;

an energy source; and an electronic timer circuit board including a motion-activated reset switch.

7. The pace clock of claim 6, wherein the clock is adapted to be mounted at a bottom of a pool and being sufficiently weighted to be free standing and stable at a pool bottom.

8. The pace clock of claim 6, wherein the reset switch is a mercury switch.

9. The pace clock of claim 6, wherein the reset switch is activated by tilting the pace clock.

10. The pace clock of claim 6, wherein the time display panel includes a digital display that is readily visible to swimmers.

11. The pace clock of claim 6, wherein the energy source is solar based.

12. The pace clock of claim 6, wherein the energy source is a battery.

* * * * *